US008242401B2

(12) United States Patent
Jin et al.

(10) Patent No.: US 8,242,401 B2
(45) Date of Patent: Aug. 14, 2012

(54) CONTACT MATING ANGLE OF AN ELECTRICAL SWITCH

(75) Inventors: Feng Jin, Milford, CT (US); Edward J. McGuinness, Milford, CT (US)

(73) Assignee: Hubbell Incorporated, Shelton, CT (US)

( * ) Notice: Subject to any disclaimer, the term of this patent is extended or adjusted under 35 U.S.C. 154(b) by 801 days.

(21) Appl. No.: 11/902,513

(22) Filed: Sep. 21, 2007

(65) Prior Publication Data

US 2008/0078667 A1 Apr. 3, 2008

Related U.S. Application Data

(60) Provisional application No. 60/827,709, filed on Sep. 30, 2006.

(51) Int. Cl.
*H01H 21/82* (2006.01)

(52) U.S. Cl. ..... 200/558; 200/241

(58) Field of Classification Search ..... 200/558, 200/242, 241

See application file for complete search history.

(56) References Cited

U.S. PATENT DOCUMENTS

| | | | | |
|---|---|---|---|---|
| 1,700,875 | A | 2/1929 | Bell | |
| 3,243,548 | A | 3/1966 | Kjellman et al. | |
| 3,294,932 | A * | 12/1966 | Barlow | 200/437 |
| 3,596,022 | A | 7/1971 | Gaber et al. | |
| 3,879,592 | A * | 4/1975 | Comerford et al. | 200/438 |
| 3,935,411 | A | 1/1976 | Ford | |
| 3,989,915 | A | 11/1976 | Nishikawa | |
| 4,138,602 | A | 2/1979 | Eley | |
| 4,332,991 | A | 6/1982 | Nordstrom | |
| 4,352,965 | A | 10/1982 | Sorenson | |
| 4,490,591 | A * | 12/1984 | Page | 200/437 |
| D280,615 | S | 9/1985 | Beck et al. | |
| D280,718 | S | 9/1985 | Ohashi | |
| D280,719 | S | 9/1985 | Ohashi | |
| 4,632,491 | A | 12/1986 | Lutz | |
| 4,686,339 | A | 8/1987 | Sapone | |
| 4,689,451 | A | 8/1987 | Resh | |
| D296,326 | S | 6/1988 | Osika | |
| D296,327 | S | 6/1988 | Osika | |
| 4,777,333 | A | 10/1988 | Valenzona | |
| D299,642 | S | 1/1989 | Kamisada | |
| 5,158,172 | A | 10/1992 | Roeser et al. | |
| 5,329,163 | A * | 7/1994 | Satoh et al. | 307/10.1 |
| 5,391,847 | A * | 2/1995 | Gallone | 200/244 |
| 5,568,860 | A * | 10/1996 | Stringwell et al. | 200/242 |
| 5,967,297 | A | 10/1999 | Kaufman et al. | |
| 6,459,060 | B1 | 10/2002 | Bartok | |

(Continued)

*Primary Examiner* — Renee Luebke
*Assistant Examiner* — Lheiren Mae A Caroc
(74) *Attorney, Agent, or Firm* — Garrett V. Davis; Mark S. Bicks; Alfred N. Goodman

(57) ABSTRACT

An electrical switch having a housing with a support member, a rocker arm pivotally coupled to the support member for movement about an axis A, a first terminal coupled to the housing, and a lever pivotally coupled to the housing for pivotal movement about an axis B. The rocker arm includes a first member located on a first side of the pivot axis A, a second member on a second side of the pivot axis A, and a first movable contact coupled to the first member. The lever is pivoted in a first direction to engage the first member on the rocker arm to move the first movable contact away from the first terminal contact to scrape debris from the first movable contact and the first terminal contact. The lever is pivoted in a second direction to engage the second member on the rocker arm to move the first movable contact into a sliding engagement with the first terminal contact.

25 Claims, 5 Drawing Sheets

U.S. PATENT DOCUMENTS 6,534,734 B2 3/2003 Davis
6,559,393 B2 * 5/2003 Nishikawa ..... 200/6 R
6,713,696 B1 3/2004 Skarlupka et al.
6,714,108 B1 3/2004 Simms et al.
7,049,538 B2 5/2006 Camillo
2005/0006218 A1 1/2005 Kwong

* cited by examiner

CONTACT MATING ANGLE OF AN ELECTRICAL SWITCH

CROSS-REFERENCE TO RELATED APPLICATIONS

This application claims the benefit of U.S. Provisional Application 60/827,709 filed Sep. 30, 2006, which application is hereby incorporated by reference in its entirety.

FIELD OF THE INVENTION

The present invention relates to an electrical switch comprising a housing with a support member, a rocker arm pivotally coupled to the support member for movement about an axis A, a first terminal coupled to the housing, and a lever pivotally coupled to the housing for pivotal movement about an axis B. The rocker arm includes a first member located on a first side of the pivot axis A, a second member on a second side of the pivot axis A, and a first movable contact coupled to the first member. When the lever is pivoted in a first direction, it engages the first member on the rocker arm to move the first movable contact away from the first terminal contact and to scrape debris from the first movable contact and the first terminal contact while providing electrical connection between the first movable contact and the first terminal contact. When the lever is pivoted in a second direction, it engages the second member on the rocker arm to move the first movable contact into a sliding engagement with the first terminal contact.

BACKGROUND OF THE INVENTION

Conventional electrical switches generally have first and second movable contacts connecting to terminal contacts are widely used. In certain situations where the switches are operating at low current loads or in unclean environments, performance of the switches has been negatively affected. There is a buildup of debris on the movable and fixed contacts that forms over time due to various factors. With some switches, the continual opening and closing of switches causes contaminants to fuse onto the contact surfaces. Over time, as the amount of debris and contaminants disposed on the surfaces increases, the performance of the switch decreases.

Accordingly, a need exists for an electrical switch having the ability to eliminate debris on its contacts at an angle suitable for the contacts to effectively transport electrical current therebetween.

SUMMARY OF THE INVENTION

Accordingly, an object of the present invention is to provide an electrical switch having at least one fixed contact and at least one movable contact such that the movable contact engages the fixed contact upon the pivotal movement of a lever upon a rocker arm.

Another object of the invention is to provide an electrical switch having at least one movable contact disposed at a certain angle with respect to the rocker arm such that when the rocker arm pivots, the movable contact separates from the fixed contact at an angle adapted to eliminate debris.

A further object of the invention is to provide a rocker arm having barriers along its surface to control the pivot range of the lever.

Still another object of the invention is to provide a handle with a spring-loaded lever for maintaining a plunger in constant contact with the rocker arm.

Yet another object of the invention is to provide a second fixed contact and a second movable contact such that when the first fixed contact engages the first movable contact creating a closed connection, the second fixed contact and second movable contact are unattached, thus creating an open connection for the flow of electrical current.

The foregoing objects are basically attained by providing an electrical switch comprising a housing with a support member, a rocker arm pivotally coupled to the support member for movement about an axis A, a first terminal coupled to the housing, and a lever pivotally coupled to the housing for pivotal movement about an axis B. The rocker arm includes a first member located on a first side of the pivot axis A, a second member on a second side of the pivot axis A, and a first movable contact coupled to the first member. The lever is pivoted in a first direction to engage the first member on the rocker arm to move the first movable contact away from the first terminal contact to scrape debris from the contact surfaces. The lever is pivoted in a second direction to engage the second member on the rocker arm to move the first movable contact into a sliding engagement with the first terminal contact.

By forming the electrical switch in this manner, the movable contacts attached to the rocker arm and the fixed contacts adjacent to the terminals are engaged at an angle such that the frictional forces upon separation cause a scraping of the contact surfaces which eliminates any debris or contaminants present on the contact surfaces.

As used in this application, the terms "top", "bottom", and "side" are intended to facilitate the description of the electrical switch, and are not intended to limit the description of the electrical switch to any particular orientation.

Other objects, advantages, and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure.

Throughout the drawings, like reference numerals will be understood to refer to like parts, components, and structures.

DETAILED DESCRIPTION OF THE INVENTION

Figure 1:
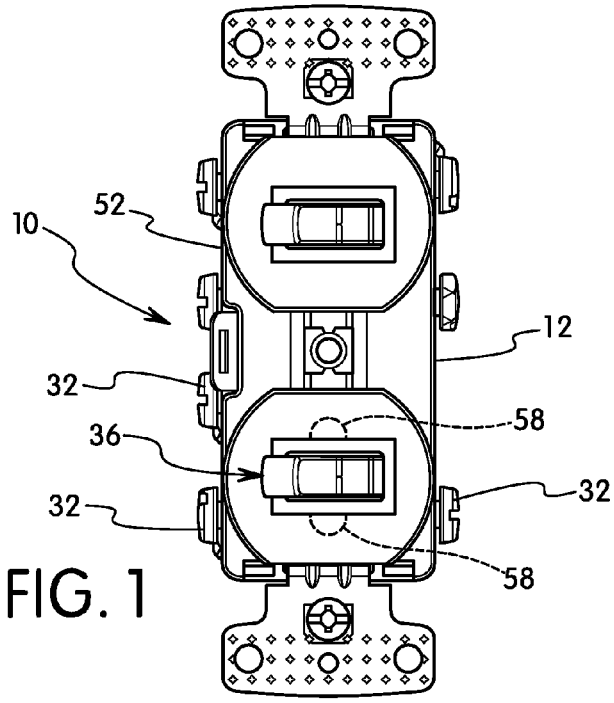
FIG. 1 is a front, elevational view of the electrical switch according to an embodiment of the present invention.
Figure 2:
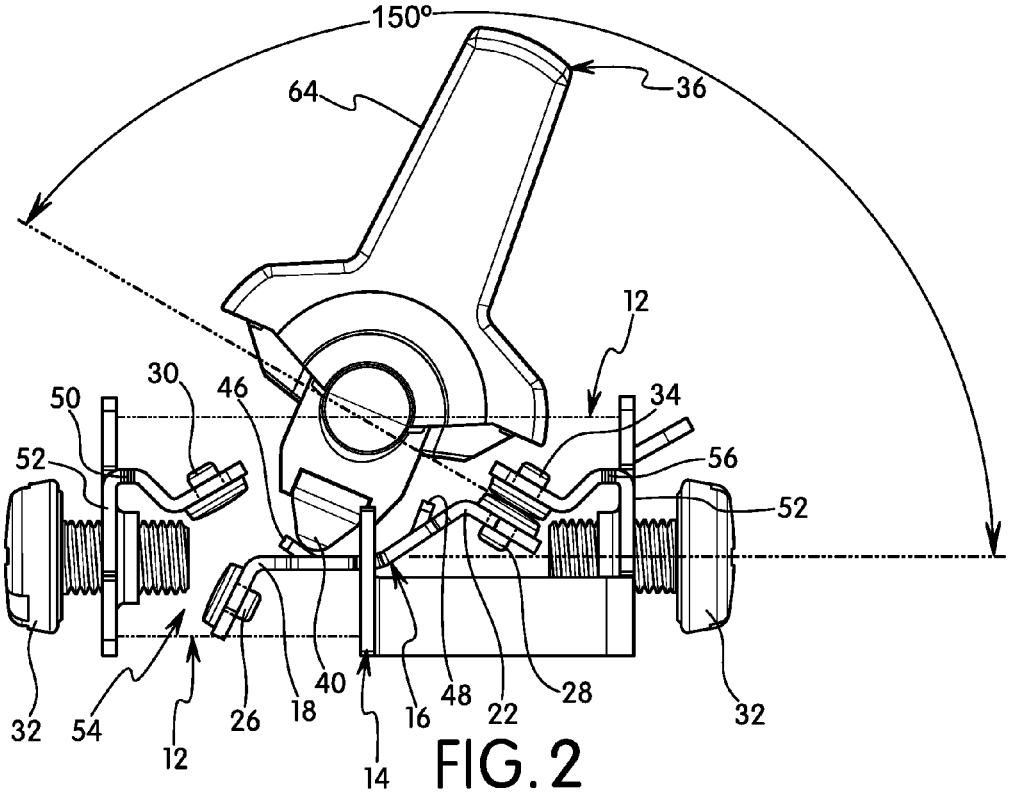
FIG. 2 is a side, elevational view of the electrical switch in FIG. 1 with one of the levers activating the rocker arm and the plunger pivoted to a first barrier of the rocker arm such that the second movable contact and second terminal contact are engaged.

Turning to FIGS. 1 and 2, an electrical switch 10 is illustrated having a housing 12 with a support member 14, a rocker arm 16 with first and second members 18, 22 having first and second movable contacts 26, 28, respectively, and a lever 36 pivotally connected to the housing 12. The lever 36 pivots about a pivot axis B to control the movement of the first and second members 18, 22 located on opposite sides of a pivot axis A. With this pivotal movement, the first movable contact 26 engages the first terminal contact 30 or, as shown in FIG. 2, the second movable contact 28 engages the second terminal contact 34.

The housing 12 is substantially rectangularly shaped, as seen in FIG. 1. More specifically, FIG. 2 illustrates the internal housing 12 having a first terminal 50 coupled thereto and projecting from a terminal wall 52 towards the interior 54 of the housing 12. A first terminal contact 30 is located at the end of the first terminal 50. The first terminal contact 30 serves as an electrical conduit for transporting electricity when the first terminal contact 30 contacts the movable contact 26. A second terminal 56 is also disposed on the housing 12 along the terminal wall 52 opposite the first terminal 50 and includes a second terminal contact 34 at its end.

Both of the terminals 50, 56 are resilient members secured to opposing sides of the housing 12 by internal housing support walls with terminal screws 32 threaded thereon. Their resiliency allows for a slight degree of movement of the terminal contacts 30, 34 if necessary, upon engagement with the movable contacts 26, 28.

As seen in FIG. 2, the housing 12 further includes a support member 14 fixedly coupled towards a center of the housing 12 for supporting the rocker arm 16. The support member 14 is preferably made of the same material as each of the terminals 50, 56. The support member 14 is disposed between trunnions 58 for enhancing or supporting its position as the rocker arm 16 pivots thereon.

Figure 3:
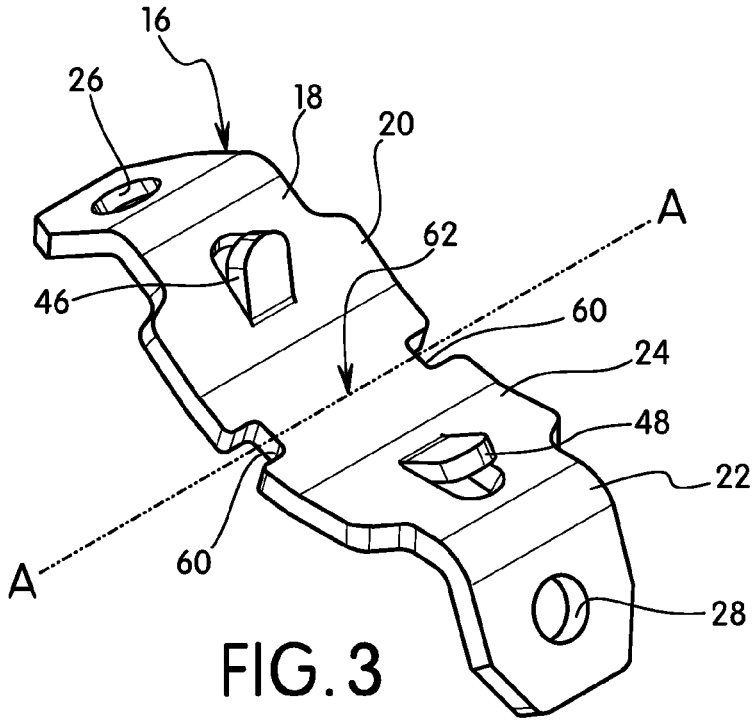
FIG. 3 is a side, perspective view of the rocker arm as seen in FIG. 2.

The rocker arm 16 is pivotally coupled to the support member 14 for pivotal movement about axis A. Upon pivotal movement of the rocker arm 16, one of the first and second movable contacts 26, 28 elevates from the bottom of the housing 12 and the other of the first and second movable contacts 26, 28 descends towards the bottom of the housing 12. As seen in FIG. 3, the rocker arm 16 is longitudinally shaped having notches 60 at its midpoint and disposed transverse to the longitudinal axis of the rocker arm 16. The notches 60 are substantially U-shaped and adapted to receive vertical protrusions of support member 14 (illustrated in FIG. 2).

Figure 4:
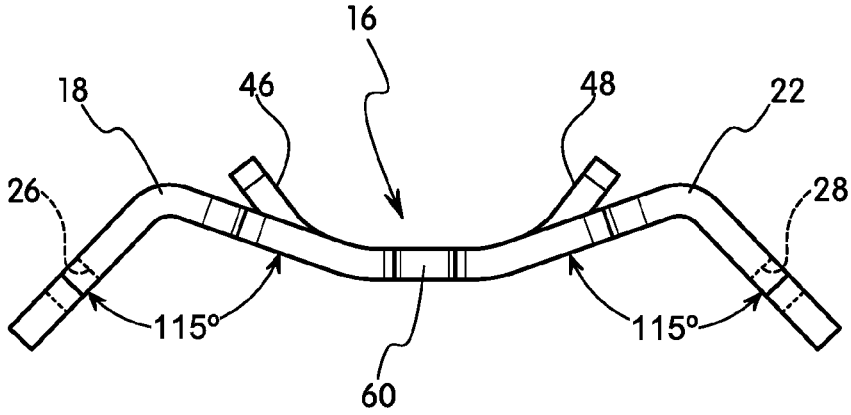
FIG. 4 is a side, elevational view of the rocker arm as seen in FIGS. 2 and 3.

As illustrated in FIGS. 3 and 4, the rocker arm 16 includes a first member 18 located on a first side 20 of the pivot axis A and a second member 22 located on a second side 24 of the pivot axis A. The first member 18 and second member 22 are cam surfaces each having an angular displacement of about 115°, shown in FIG. 4. The first member 18 further includes a first barrier 46 projecting from its surface at an angle of approximately 145° from the center and in the direction of the exterior of the housing 12, and the second member 22 includes a second barrier 48 projecting from its surface at an angle of approximately 145° from the center and opposite the projection angle of the first barrier 46.

The first and second barriers 46, 48 are substantially U-shaped tabs stamped from the rocker arm 16 with the first barrier 46 cut from the surface of the first member 18 and the second barrier 48 cut from the surface of the second member 22. The first and second barriers 46, 48 are acutely angled towards the first and second members 18, 22, respectively and are adapted to prevent the plunger 40 from pivoting across the entire distance between the first and second members 18, 22. Thus, the barriers 46, 48 form stops or walls along the surface of the rocker arm 16.

The rocker arm 16 further includes a concave surface portion 62 adjacent to the notches 60 and between the barriers 46, 48 adapted for receiving the plunger 40 of the lever 36.

The outer ends of the rocker arm 16 include first and second movable contacts 26, 28 disposed along the outer ends of the first and second sides 20, 24 on the opposite side of the cam surface as the side upon which the barriers 46, 48 are located. The first movable contact 26 is coupled to the first member 18 and the second movable contact 28 is coupled to the second member 22.

Figure 5:
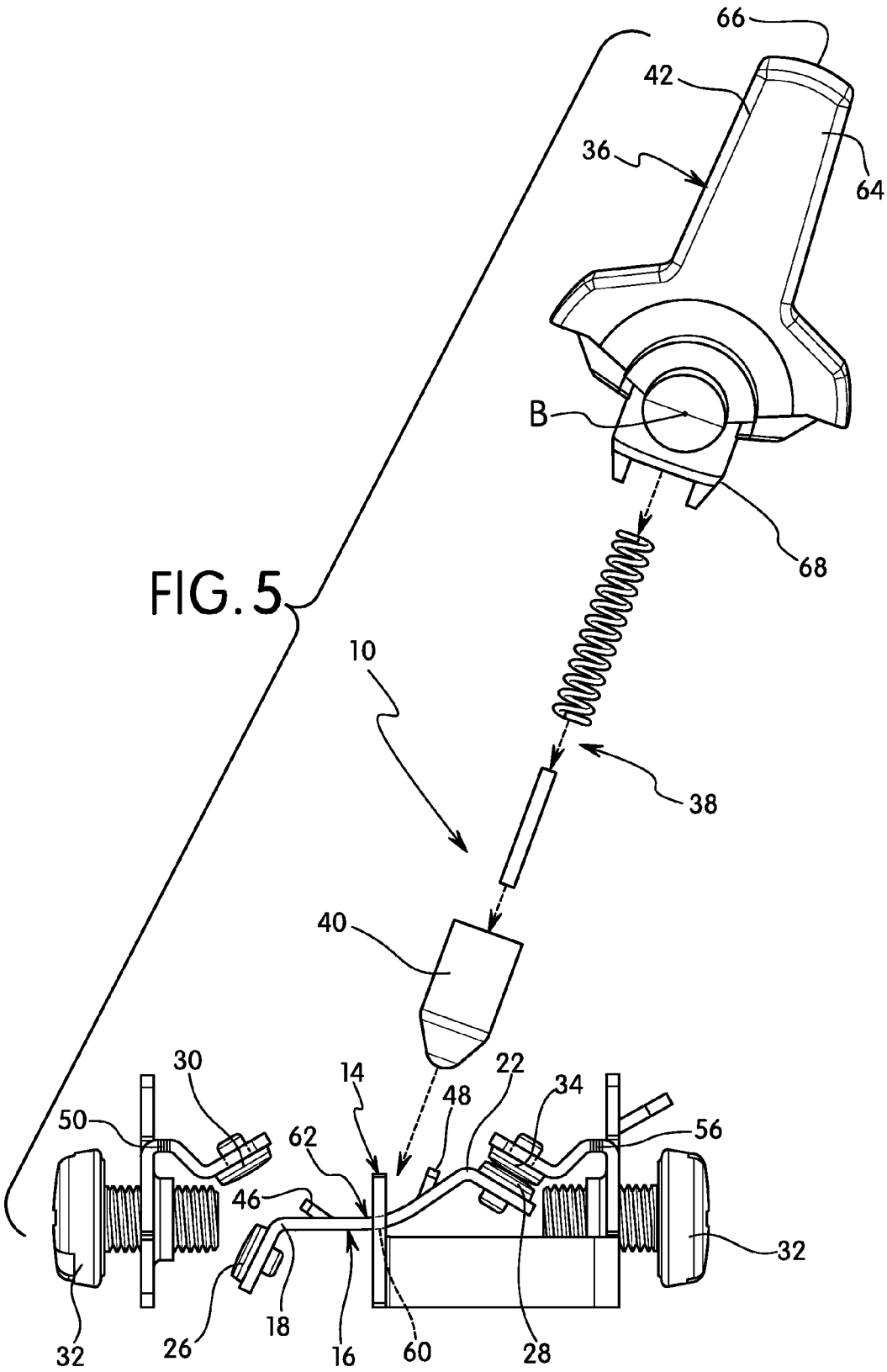
FIG. 5 is a side, exploded elevational view of the electrical switch as seen in FIGS. 1 and 2.

The housing 12 further includes a lever 36 pivotally coupled thereto for pivotal movement about axis B. More specifically, the lever 36 is pivotally supported by the support member 14 because the width of the lever 36 at its bottom or second end 68 is equivalent to approximately the same distance as the space between each of the notches 60. As seen in FIG. 5, the lever 36 includes a handle 64 at a first end 66 away from the rocker arm 16, a plunger 40 at a second end 68 adjacent to the rocker arm 16, and a spring 38 disposed internally therebetween.

Figure 8:
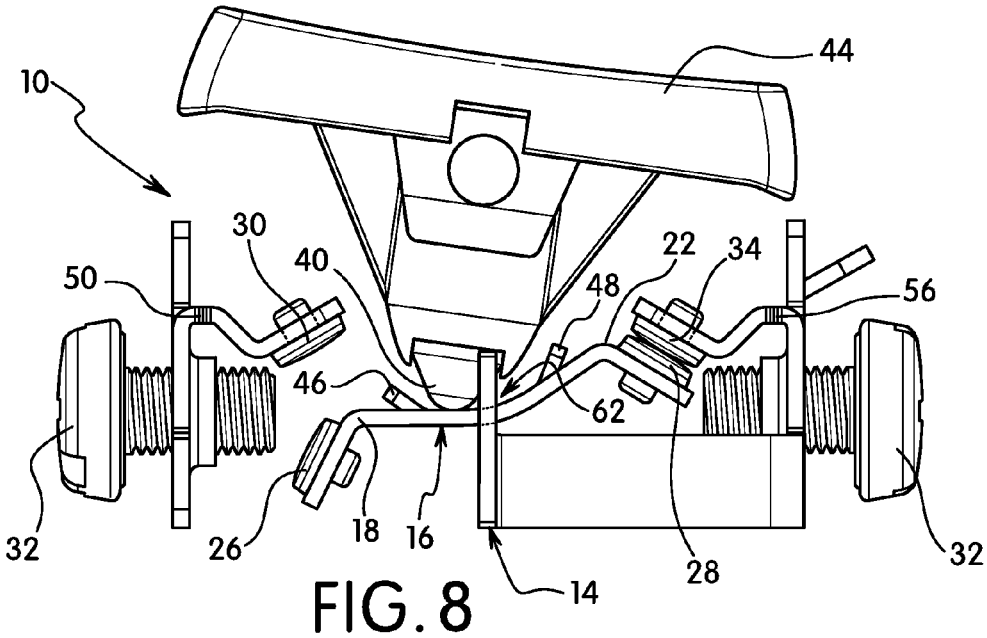
FIG. 8 is a side, elevational view of an electrical switch according to a second embodiment of the invention as seen in FIGS. 1-7.

The handle 64 is a substantially rectangularly-shaped planar surface oriented parallel to the support member 14. This style is commonly known as a toggle switch and is prevalent in commercial and residential lighting applications. In an alternative embodiment seen in FIG. 8, the handle 64 of a decorator style electrical switch 10 is characterized by a substantially rectangularly-shaped planar surface oriented perpendicularly to the support member 14.

The handle 64 activates the mechanism to alternately complete or break the electrical circuit. For purposes of illustration and description, although the switch illustrated represents a three-way switch and either set of engaged contacts could represent an "on" or "off" position, in this section, FIG. 7 will be known as the "on" position and FIG. 2 as the "off" position, respectively. When the handle 64 is activated to an "on" position, the appropriate contacts are connected such that current flows through the circuit. When the handle 64 is activated into an "off" position, the appropriate contacts are separated prohibiting the flow of current therethrough.

The plunger 40 is curved to easily slide along the bottom end 68 of the lever 36 adapted for pivoting through the rocker arm concave surface portion 62. The spring 38 is compressed or extended between the plunger 40 and the handle 64 depending on the position of the plunger 40 with respect to the concave surface portion 62. The spring 38 exerts a force between the handle 64 and the plunger 40 such that the plunger 40 is adapted to pivot about the pivot axis B along the rocker arm 16 through the concave surface portion 62 between the first and second barriers 46, 48. The lever 36 is spring-loaded to maintain the plunger 40 in constant contact with the rocker arm 16.

Pivot axis B is parallel to pivot axis A and is located towards the second end 68 of the lever 36 adjacent to the rocker arm 16. When the lever 36 is activated, it pivots about pivot axis B as the plunger 40 engages the rocker arm 16 and, thus, the position of the plunger 40 is controlled by a pivotal position of the lever 36 about the pivot axis B.

Operation

Figure 6:
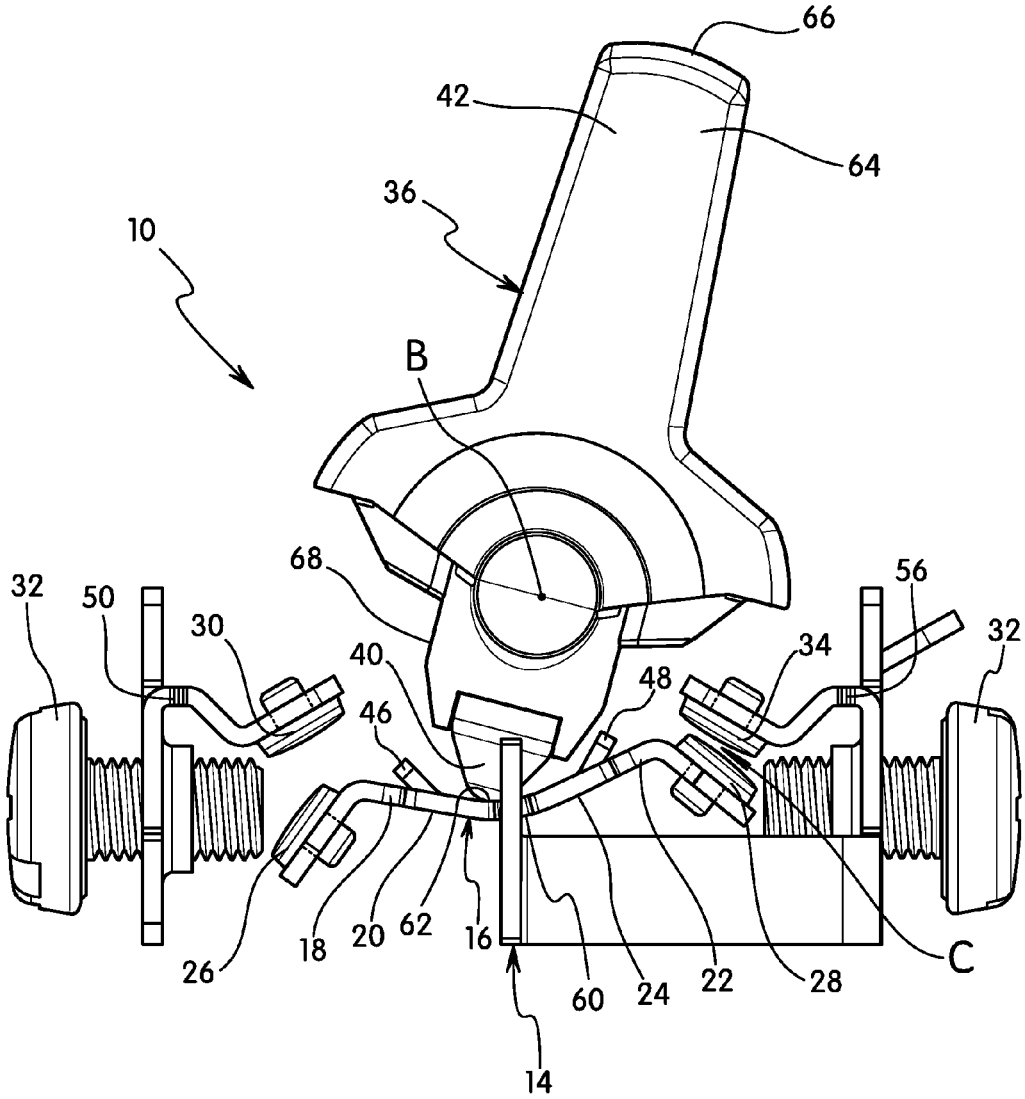
FIG. 6 is a side, elevational view of the electrical switch seen in FIG. 5 with the plunger pivoted across the rocker arm and the rocker arm pivoted along the support member such that first and second movable contacts are separated from first and second terminal contacts.
Figure 7:
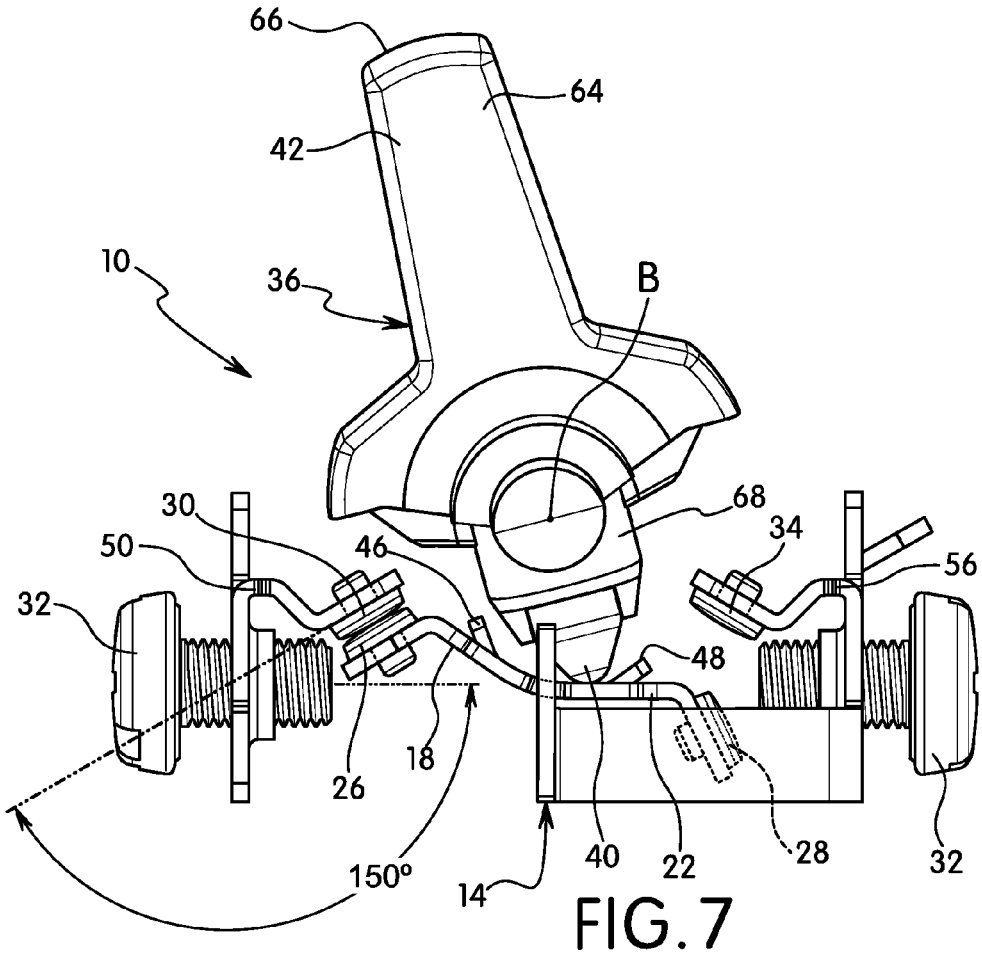
FIG. 7 is a side, elevational view of the electrical switch seen in FIGS. 5 and 6 with the plunger pivoted all the way across the rocker arm and the rocker arm pivoted along the support member such that the first movable contact and first terminal contact are engaged.

Essentially, the operation of the switch 10 is best illustrated in reference to FIGS. 2, 6, and 7. Turning to the "ON" position of FIG. 7, force is applied to the handle 64 to move the plunger 40 of the lever 36 across the concave surface portion 62 of the rocker arm 16. The lever 36 is pivoted about axis B in a first direction to engage the second member 22 on the rocker arm 16 which moves the second movable contact 28 away from the second terminal contact 34. The plunger 40 is adjacent to barrier 48 such that the first terminal contact 30 and the first movable contact 26 are engaged to permit the flow of current.

The rocker arm 16 controls the orientation of the movable contacts 26, 28 with respect to the terminal contacts 30, 34 to create a first shear position which is the angle of engagement between the first terminal contact 30 and the first movable contact 26. Prior to actual shearing of the contacts 26, 30, the first terminal contact 30 and the first movable contact 26 are engaged when the first movable contact 30 is approximately 150° measured from the horizontal in the direction away from the second member 22. At this angle, the opposing second terminal contact 34 and the second movable contact 28 are at the furthest distance from each other which opens the circuit. This orientation removes current from the circuit to a light source. A person of reasonable skill in the art would understand that the angular displacement does not have to equal 150° so long as the contacts are attached when the plunger 40 slides across the rocker arm 16 and the opposing contacts are separated so current flows therethrough.

From the ON position of FIG. 7, the lever 36 is pivoted in a second direction to engage the first member 18 on the rocker arm 16 which moves the first movable contact 26 through a sliding or shearing engagement with the first terminal contact 30 to ultimately remove electrical connection between the first movable contact 26 and the first terminal contact 30.

More specifically, the rocker arm 16 pivots along the axis A while balancing on the support member 14 to elevate the second movable contact 28 from the bottom of the housing 12 towards the second terminal contact 34, as seen in FIG. 6. This movement is triggered as the plunger 40 moves through the concave surface portion 62 from barrier 48 to barrier 46. The plunger 40 has passed from the second side 24 of the rocker arm 16, through the center of the rocker arm 16 to the other side of the support member 14 and thus, the first side 20 of the rocker arm 16.

Further, when the plunger 40 moves towards the first side 20, the rocker arm 16 moves in an opposite direction such that the first movable contact 26 separates from the first terminal contact 30 and the second movable contact 28 simultaneously moves towards the second terminal contact 34 towards a second shear position (FIG. 2).

Internally, with respect to the lever 36, when the plunger 40 is located directly between the first and second barriers 46, 48, i.e., the bottom tip of the plunger 40 contacts the rocker arm 16 at support member 14, the spring 38 is maximally compressed. When the plunger 40 is either disposed adjacent to the first barrier 46 or the second barrier 48, the spring 38 is fully extended. In this manner, the force of the spring 38 enables the lever 36 to pivot about the pivot axis B such that the rocker arm 16 pivots about the pivot axis A. This causes the second movable contact 28 to rise towards the second terminal contact 34 and the first movable contact 26 to descend away from the first terminal contact 30. Thus, the side to which the plunger 40 is disposed and therefore, the side to which the spring 38 is extended is the same side to which the respective movable contact and terminal contact are open.

As seen in FIG. 2, the rocker arm 16 causes the contacts 28, 34 to engage. The contacts pass through angle c (as seen in FIG. 6) prior to and after attachment, but the shearing occurs after the attachment when the contacts are separating. When passing through angle c upon separation, the shearing force triggers the removal of debris and contaminants from the contact surfaces as a result of the horizontal and vertical movement of the movable contact 28 separating from the terminal contact 34 wherein the movable contact and the terminal contact start from a non-zero angle, preferably an angle c approximately greater than 10° and less than 30°.

This removal enhances the electrical connection between the contact surfaces. A person of reasonable skill in the art would understand that the angular displacement does not have to be approximately greater than 10° and less than 30° so long as there is a horizontal and vertical component upon separation of the contacts. Nevertheless, the first movable contact 26 and the first terminal contact 30 are engaged at a non-zero angle when the first movable contact 26 is disposed approximately 150° from a horizontal axis prior to separation.

Prior to shearing of the second movable contact 28 and the second terminal contact 34 (as seen in FIG. 2), the second movable contact 28 is disposed approximately 150° as measured from the horizontal. As described above, when the switch 10 is engaged in this position, the first movable contact 26 and the first terminal contact 30 cannot be adjacent to each other and have thus, already passed through a first shear position.

These shearing angles represent the positions prior to the vertical and horizontal movement of the movable contacts separating from the terminal contacts to cause a removal of debris from the surface therebetween. The first shear position represents the separation of the first movable contact 26 from the first terminal contact 30. The second shear position represents the separation of the second movable contact 28 from the second terminal contact 34.

To continue the ON/OFF power motion, the first movable contact 26 moves towards the first terminal contact 30 at a contact angle of 150° when the plunger 40 is disposed on the second side 24 of the rocker arm 16 and the first movable contact 26 moves away from the first terminal contact 30 when the plunger 40 is disposed on the first side 20 of the rocker arm 16. Likewise, the second movable contact 28 moves towards the second terminal contact 34 at a contact angle of 150° when the plunger 40 is disposed on the first side 20 of the rocker arm 16 and the second movable contact 28 moves away from the second terminal contact 34 when the plunger 40 is disposed on the second side 24 of the rocker arm 16.

While a particular embodiment has been chosen to illustrate the invention, it will be understood by those skilled in the art that various changes and modifications can be made therein without departing from the scope of the invention as defined in the appended claims.

What is claimed is:

1. An electrical switch comprising:

a housing having a support member;

a rocker arm pivotally coupled to said support member for pivotal movement about a first axis A and having a first member located on a first side of said axis A, a second member located on a second side of said axis A, and a first substantially planar contact surface on a movable contact coupled to said first member, said rocker arm having a substantially V-shape defining a concave top portion between said first and second members and defining a fulcrum at an apex between said first and second members and being coupled to said support member at said fulcrum;

a first substantially planar terminal contact coupled to said housing, said first terminal contact having a planar contact surface for contacting said planar contact surface of said first terminal contact;

a lever pivotally coupled to said housing for pivotal movement about a second axis B, said lever being pivoted in a first direction to engage said first member on said rocker arm to move said planar contact surface of said movable contact away from said planar contact surface of said first terminal contact to scrape debris from said planar contact surface of said movable contact and said planar contact surface of said movable contact, planar contact surface of said, said lever being pivoted in a second direction to engage said second member on said rocker arm to move said first movable contact into a sliding engagement with said first terminal contact; and said axis A is substantially parallel to said first substantially planar terminal contact and said first substantially planar contact surface on the movable contact.

2. An electrical switch according to claim 1 wherein said support member is fixedly coupled to said housing.

3. An electrical switch according to claim 1 wherein said first and second members are disposed at an angle of about 115° with respect to each other.

4. An electrical switch according to claim 1 wherein said first terminal contact is resiliently coupled to said housing.

5. An electrical switch according to claim 1 wherein said axis A is parallel to said axis B.

6. An electrical switch according to claim 1 further including a second terminal contact resiliently coupled to said housing opposite said first terminal contact; and a second movable contact coupled to said second member of said rocker arm.

7. An electrical switch according to claim 6 wherein first and second movable contacts are disposed at an angle of approximately 115° with respect to each other.

8. An electrical switch according to claim 6 wherein said rocker arm includes a second shear position at an angle of approximately less than 30° between said planar contact surface of the movable contact and the planar contact surface of the terminal contact when said second movable contact separates from said second terminal contact.

9. An electrical switch according to claim 8 wherein said second shear position is further defined by said planar contact surface of said movable contact moving away from said planar surface contact of said first terminal contact wherein a first movable contact and said first terminal contact are at a non-zero angle with respect to each other.

10. An electrical switch according to claim 1 wherein said lever further includes a spring and a plunger at an end closest to said rocker arm adapted to slide along said rocker arm such that a first movable contact moves upwardly when said plunger is disposed on said second side of axis A and moves downwardly when said plunger is disposed on said first side of axis A.

11. An electrical switch according to claim 1 wherein said first and second members of said rocker arm are cam surfaces.

12. An electrical switch according to claim 1 wherein said rocker arm includes a first shear position at an angle of approximately less than 30° between the planar contact surface of the movable contact and the planar contact surface of the terminal contact, said first movable contact separates from said first terminal contact.

13. An electrical switch according to claim 1 wherein said lever is spring biased having a substantially rectangularly-shaped planar surface area oriented parallel to said support member.

14. An electrical switch according to claim 1 or 13 wherein the axis B is located towards a lower end of said lever adjacent to said rocker arm such that said lever pivots about the axis B with said plunger engaging said rocker arm wherein the position of said plunger is controlled by a pivotal position of said lever about the axis B.

15. An electrical switch according to claim 1 wherein said rocker arm includes a first barrier projecting upward from said first member and a second barrier projecting upward from said second member, wherein each of said barriers is acutely angled towards each of said members, respectively such that said barriers are adapted to define a stop member and prevent said plunger from sliding across an entire distance between said first and second members.

16. An electrical switch comprising:

a housing having a support member;

a rocker arm pivotally coupled to said support member for pivotal movement about a first axis and having a first member located on a first side of said first axis, a second member located on a second side of said first axis, a first substantially planar movable contact having a planar contact surface coupled to said first member, and a second substantially planar movable contact having a planar contact surface coupled to said second member, said rocker arm having a V-shape defining a concave top surface and a fulcrum at an apex between said first member and second member, said rocker arm being coupled to said support member at said apex;

first and second substantially planar terminal contacts coupled to said housing and having a planar contact surface facing said top surface of said rocker arm and said first and second movable contacts, respectively;

said first and second substantially planar movable contacts and said first and second substantially planar terminal contacts are parallel to the first axis;

a lever pivotally coupled to said housing for pivotal movement about a second axis, said lever being pivoted in a first direction to engage said first member on said rocker arm to move said first movable contact away from said first terminal contact to scrape debris from said first movable contact and said first terminal contact, said lever being pivoted in a second direction opposite said first direction to engage said second member on said rocker arm to move said first movable contact into a sliding engagement with said first terminal contact; and first and second barriers disposed on said rocker arm and projecting from said first and second members at acute angles, respectively, such that said barriers are adapted to prevent said lever from pivoting across an entire distance between said first and second members.

17. An electrical switch according to claim 16 wherein said rocker arm includes a first shear position at an angle of approximately less than 30° with respect to a plane of said first terminal contact when said first movable contact is adjacent to said first terminal contact and a second shear position at an angle of approximately less than 30° with respect to a plane of said second terminal contact when said second movable contact is adjacent to said second terminal contact.

18. An electrical switch according to claim 16 wherein the second axis is located towards a lower end of said lever adjacent to said rocker arm such that said lever pivots about the second axis with said plunger engaging said rocker arm wherein the position of said plunger is controlled by a pivotal position of said lever about the second axis.

19. An electrical switch according to claim 16 wherein said first movable contact and said first terminal contact are engaged at a non-zero angle with respect to each other when said first movable contact is disposed approximately 150° from a horizontal axis.

20. An electrical switch comprising:

a housing having a support member;

a rocker arm pivotally coupled to said support member for pivotal movement about a first axis and having a first member located on a first side of said first axis, a second member located on a second side of said first axis, a first substantially planar movable contact coupled to said first member, and a second substantially planar movable contact coupled to said second member, said first and second members forming a substantially V-shape forming an upwardly facing concave surface and where said first pivot axis extends through an apex between said first and second members;

first and second substantially planar terminal contacts coupled to said housing, said terminal contacts having a planar contact surface for mating with said planar contact surface;

said first and second substantially planar movable contacts having planar contact surfaces and said first and second substantially planar terminal contacts are parallel to the first axis;

a lever pivotally coupled to said housing for pivotal movement about a second axis and having a spring biased plunger contacting the concave surface of said rocker arm, said lever being pivoted in a first direction to engage said first member on said rocker arm to move said first movable contact away from said first terminal contact at a non-zero angle to scrape debris from said first movable contact and said first terminal contact, said lever being pivoted in a second direction opposite said first direction to engage said second member on said rocker arm to move said first movable contact into a sliding engagement at a non-zero angle with said first terminal contact; and first and second barriers disposed on said rocker arm and projecting upward from said first and second members at acute angles, respectively, such that said barriers define stop members to prevent said lever from pivoting across an entire distance between said first and second members, and where said spring biased plunger contacts said first barrier to bias said first member away from said first terminal contact and bias said second movable contact into contact with said second terminal contact.

21. The electrical switch of claim 20, wherein:

said first terminal contact faces a top surface of said first member, and where said first movable contact extends away from said top surface of said first member at an incline whereby a planar contact surface of said first movable contact faces away from said top surface of said first member and a planar contact surface of said second movable contact.

22. An electrical switch comprising:

a housing having a support member;

a rocker arm having a first member with an upwardly facing planar first movable contact surface, a second member with an upwardly facing planar second movable contact surface, said rocker arm having a substantially V-shape defining a concave upper surface, and being pivotally coupled to said support at an apex between said first and second members;

a first planar terminal contact having a substantially planar contact surface resiliently coupled to said housing and positioned to form an initial contact angle with said first movable contact surface of about 10° to 30°;

a second terminal contact member having a planar contact surface resiliently coupled to said housing and positioned to form an initial contact angle with said second movable contact surface of about 10° to 30° to scrape debris from the contact surfaces and being movable to a closed position where said planar contact surface of said second terminal contact is substantially parallel to said planar second movable contact surface;

a lever pivotally coupled to said housing for engaging said first member of said rocker arm to pivot in a first direction to pivot said first movable contact surface away from said first terminal contact surface and move said second movable contact surface into engagement with said second terminal contact surface; and said lever being pivotable in a second direction to pivot said second member of said rocker arm away from said second terminal contact surface and move said first movable contact surface into engagement with said first terminal contact surface.

23. The electrical switch of claim 22, wherein said second movable contact surface engages said second terminal contact surface in a sliding motion at an angle where a leading edge of said second movable contact surface slides over the contact surface of said second terminal contact.

24. The electrical switch of claim 22, wherein said first movable contact surface engages said first terminal contact surface at an initial angle of about 10° to 30° to scrape debris from the contact surfaces, and being movable to a closed position where said contact surfaces are parallel.

25. The electrical switch of claim 24, wherein said first movable contact surface has a leading edge that contacts the first terminal contact surface in a sliding motion to scrape debris from said contact surfaces.

* * * * *